United States Patent [19]

Lee

[11] 3,974,424

[45] Aug. 10, 1976

[54] VARIABLE RESISTANCE BRIDGE ELEMENT

[75] Inventor: John Thomas Michael Lee, Phoenixville, Pa.

[73] Assignee: ICI United States Inc., Wilmington, Del.

[22] Filed: Oct. 7, 1974

[21] Appl. No.: 512,462

[52] U.S. Cl. ..... 317/80; 102/28 R

[51] Int. Cl.[2] ..... F42B 3/18

[58] Field of Search ..... 317/80; 102/28 R; 338/137, 195

[56] References Cited

UNITED STATES PATENTS

| | | | |
|---|---|---|---|
| 1,717,913 | 6/1929 | Brockway | 338/195 |
| 3,407,732 | 9/1968 | Przybylik et al. | 102/28 |
| 3,753,403 | 8/1973 | Menichelli | 102/28 R |

FOREIGN PATENTS OR APPLICATIONS

| | | | |
|---|---|---|---|
| 581,316 | 9/1959 | Canada | 102/28 R |

*Primary Examiner*—J. V. Truhe
*Assistant Examiner*—Clifford C. Shaw

[57] ABSTRACT

Resistance element, such as a bridge element for electro-explosive devices. The resistance element of this invention is of generally S-shaped configuration having two arcuate resistor portions which are joined by a connecting portion. The bridge element may be connected to lead wires at points along the arcuate portions. The effective resistance of the bridge element may be varied by changing the points at which connection to the lead wires is made.

7 Claims, 5 Drawing Figures

PRIOR ART

THIS INVENTION

VARIABLE RESISTANCE BRIDGE ELEMENT

BACKGROUND OF THE INVENTION

This invention relates to resistance elements, and more particularly to bridge elements for electro-explosive devices.

Electro-explosive devices (EED's) such as primers, detonators, and squibs, are well known in the art. These devices generally include a pair of lead wires which are connected through a bridge wire or other bridge element that is in contact with a deflagrating charge. The device generally has a metallic case. The bridge element is a resistance element that is usually in the form of a wire of circular cross section. The bridge wire usually has a resistance which is appreciably greater than the resistance of the lead wires. Passage of an electric current through the leads and the bridge element causes the latter to be heated, thereby firing the deflagrating charge.

A well known safety hazard of some electro-explosive devices is that they can be accidentally fired by static electricity. A safety requirement of relatively recent origin for EED's in some military specifications is the "one ampere-one watt no fire" requirement. This requirement states that a device must be capable of dissipating one watt of power while one ampere of current is passed through the bridge element without firing. This indirectly fixes the desired combined resistance of the lead wires and the bridge element at one ohm. The combined lead wire and bridge element resistance is generally held between 0.9 and 1.1 ohms. If the total resistance is too low, the one watt requirement will not be met; if it is too high, excessive heating due to higher power dissipation will result.

The passage of current through the bridge element causes its temperature to increase considerably. Heat is transferred from the bridge element to the deflagrating charge which surrounds the bridge. The charge conducts the heat to the body of the device where it is dissipated. To increase the rate of heat transfer and thereby minimize the bridge element temperature at any given current level, a bridge element shape having a greater ratio of external surface area to cross sectional area than the conventional round wire shape is required. For this reason foil bridges have been used in place of bridge wires in devices meeting the one ampere-one watt no fire requirement.

A foil bridge element which is presently in use is illustrated in FIG. 1. This device is generally circular in shape with sawtooth edges, and includes a narrow resistor section 11 of high resistance per unit length which runs along a diameter of the circle and which connects two much wider portions 12 and 13 which have sawtoothed outer edges that lie along the circumference of a circle. The outer portions 12 and 13 have holes 14 for alignment of the bridge element with respect to the lead wires (not shown) to which the bridge element is connected. Since the portions 12 and 13 are much wider than the resistor section 11, nearly all of the resistance of the bridge element is in the resistance section 11. As a corollary of this, the bridge element shown in FIG. 1 would have an essentially constant resistance regardless of the points in portions 12 and 13 at which the lead wires are connected.

The foil bridge element shown in FIG. 1 has a typical thickness of about 0.001 inch. A desirable composition for this element is an alloy containing 20% chromium, 2.75% aluminum, 2.75% copper, all percentages by weight, balance nickel. The resistivity of this alloy is 134 microhm-centimeters, or 800 ohms per circular mil foot. Thus the resistance of the linear portion of the bridge element in FIG. 1 would be about one ohm when the diameter of the circle is 0.17 inch and the width and thickness of the linear portion 11 are 0.01 and 0.001 respectively.

Processes for making foil resistance elements such as the above are known in the art. One such process is described in T. D. Schalbach and D. K. Rider, "Printed and Integrated Circuitry Materials and Processes", McGraw-Hill, New York 1963, pages 83–87.

A disadvantage of presently known bridge elements including the bridge element shown in FIG. 1, is that they have a fixed resistance. Since lead wires of various EED designs may vary in either length diameter or material, and consequently may vary in resistance, it is impossible to achieve the desired one ohm of combined lead wire and bridge element resistance with one bridge element design.

SUMMARY AND OBJECTS

It is an object of this invention to provide a resistance element, and in particular a bridge element for electro-explosive devices, having a variable effective resistance.

A more specific object of this invention is to provide a bridge element whose effective resistance can be varied by changing the points of connection to a pair of lead wires so that the combined resistance of the bridge element and the lead wires is one ohm.

The bridge element of this invention has a variable effective resistance and comprises a linear arcuate resistor portion and a second resistor portion which is joined to said arcuate portion.

THE DRAWING

DESCRIPTION OF THE PREFERRED EMBODIMENT

Figure 2:
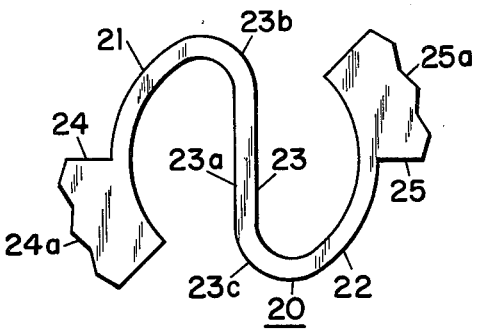
FIG. 2 is a bridge element according to the preferred embodiment of the present invention.

Referring now to FIG. 2, the resistance element shown therein is a bridge element 20 of variable effective resistance and of generally S-shaped configuration. The bridge element 20 comprises a pair of spaced linear arcuate resistor portions 21 and 22 and a linear connecting portion 23 which extends from one end of arcuate portion 21 to one end of arcuate portion 22. The connecting portion 23 has a straight middle portion **23*a* and a pair of curved transitional portions 23*b* and 23*c* which provide smooth transitions between the straight portion 23*a* and the two arcuate segments 21 and 22. The two arcuate segments 21 and 22 and the connecting portion 23 all have the same width and consequently the same resistance per unit of length. The two arcuate portions 21 and 22 represent diametrically opposite arcs of the same circle. The straight central segment 23***a* of connecting portion 23 lies along a diameter of this same circle. Curved portions 23*b* and 23*c* are also arcuate segments, and have a smaller radius of curvature than the arcuate segments 21 and 22. The arcuate portions 21 and 22 and the connecting portion 23 form a smooth continuous linear curved structure of essentially uniform width and essentially uniform resistance per unit length. The resistance element 20 has a pair of generally fan-shaped end portions 24 and 25 which are integrally joined to the arcuate segments 21 and 22 respectively at the free ends thereof. The fan-shaped portion 24 and 25 have sawtooth edges 24*a* and 25*a* respectively in order to facilitate static discharge from the bridge element 20 to the metallic case of the EED. The outermost points in sawtooth edges 24*a* and 25*a* lie in a circle which is normally of substantially greater diameter than the diameter of the circle in which arcuate portions 21 and 22 lie.

Figure 1:
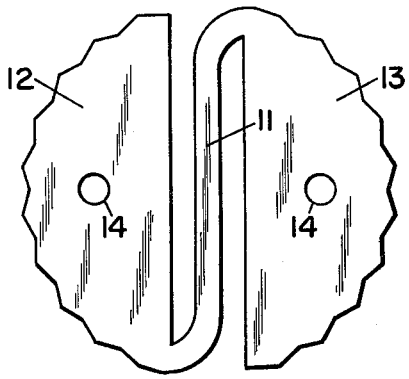
FIG. 1 is a bridge element according to a prior art construction.

Bridge element 20 is a metal or alloy foil of suitable resistance material. Known resistance alloys, such as nichrome can be used. A preferred resistance alloy is an alloy having the nominal composition of 20% chromium, 2.75% aluminum, 2.75% copper, all by weight, balance nickel. This is the same alloy composition that has been used in the known bridge element described in FIG. 1. A suitable thickness is approximately 0.001 inch, although greater or lesser thicknesses can be used.

By way of example, a bridge element according to FIG. 2 having a maximum effective resistance of one ohm may have the following composition and dimensions: Composition: 20.0% Cr., 2.75% Al, 2.75% Cu., balance Ni (all percentages by weight.) Dimensions: Thickness, 0.001 inch; overall diameter, 0.170 inch; width of portions 21, 22, and 23, 0.06 inch; mean diameter of arcuate portions 21 and 22, 0.056 inch; length of straight segment 23*a*, 0.022 inch; and mean radius of curved portions 23*b* and 23*c*, 0.012 inch. (Overall diameter refers to the diameter of the circle in which sawtooth edges 24*a* and 25*a* lie).

By way of another specific example, a bridge element as shown in FIG. 2 having a maximum resistance of one ohm can be formed of the alloy composition described in the previous example with a thickness of 0.001 inch. The resistor portions 21, 22, and 23 in this specific example have a width of 0.006 inch each. Arcuate portions 21 and 22 have an inside radius of 0.019 inch (and a mean radius of 0.022 inch); straight portion 23*a* has a length of 0.030 inch; and the transition portions 23*b* and 23*c* have a mean radius of 0.006 inch. The overall diameter of the resistance element is 0.070 inch. This second specific embodiment is of the same basic S-shaped configuration as the first although the two embodiments differ in dimensions. The second specific embodiment has a smaller overall diameter and more sharply curved transitional sections 23*a* and 23*b* than the first, but the resistances of both elements are about the same.

The embodiment of FIG. 2 can be modified by substituting a non-linear connecting portion of comparatively low resistance for the linear connecting portion 23 if desired.

More broadly, the bridge element of this invention may comprise a linear arcuate resistor portion 21 and a second resistor portion which is joined to said arcuate portion. This second resistor portion need not be linear. One lead may be attached at a point along the arcuate portion 21 and the other lead may be attached to the second resistor portion. The preferred embodiment described with reference to FIG. 2 is a specific embodiment of the broader device in which the second resistor portion includes the second arcuate resistor portion 22 and the connecting portion 23.

Figure 3:
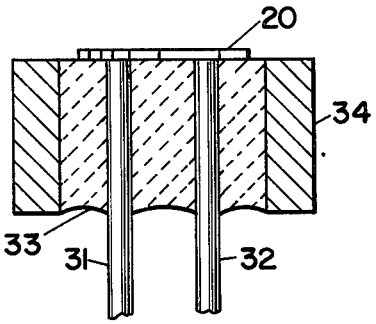
FIG. 3 is a vertical sectional view of a plug assembly which includes a pair of electrical leads and a bridge element according to the present invention.

Referring now to FIG. 3, there is shown a plug assembly comprising a pair of leads 31 and 32, a glass insulator plug 33, a metal sleeve 34 (which may be omitted) surrounding the glass plug 33, and a bridge element 20 according to this invention. The glass plug 33 is bonded to both the electrical leads and to the metal sleeve 34. Plug 33 maintains a predetermined distance between the tips of leads 31 and 32. Plug assemblies which differ from that of FIG. 3 only in the bridge element configuration are known in the art, as shown for example in U.S. Pat. Nos. 3,336,452 to Baker and 3,793,501 to Stonestrom. The electrical leads 31 and 32 may be (and normally are) insulated except for the ends and the portions which extend through the glass plug 33.

Figure 4:
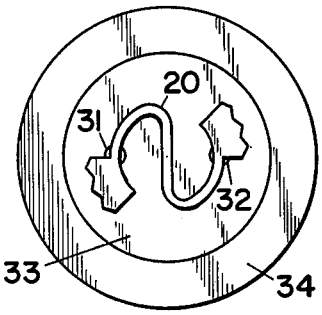
FIG. 4 is a top plan view of the plug assembly shown in FIG. 3, showing the bridge element positioned for maximum resistance.

Referring now to FIG. 4, a bridge element 20 is shown in the position giving maximum resistance. In all cases it is contemplated that the leads 31 and 32 will be attached to the bridge element 20 along the arcuate portions 21 and 22, with one lead (e.g. lead 31) attached to arcuate portion 21 and the other lead (e.g. lead 32) attached to the other arcuate portion 22. The leads may be attached to the bridge element by conventional means such as soldering or resistance welding. In the maximum resistance position shown in FIG. 5, the leads 31 and 32 are attached to the bridge element 20 at the ends of arcuate portions 21 and 22 which are adjacent to the end portions 24 and 25. This gives a resistance path of maximum length through the arcuate portions 21 and 22, and the connecting portion 23 of bridge element 20. The end portions 24 and 25 do not constitute a part of the electrical circuit; these portions are provided for more efficient discharge of static electricity.

Figure 5:
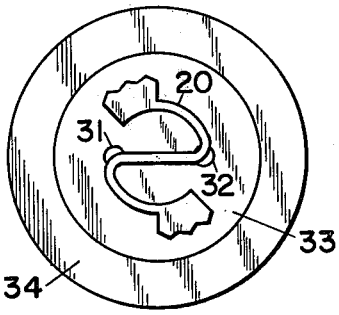
FIG. 5 is a top plan view of the plug assembly shown in FIG. 4, showing the bridge element positioned for minimum resistance.

Referring now to FIG. 5, the resistance element 20 is shown in the position for minimum resistance. In this position, the leads 31 and 32 are again attached to arcuate portions 21 and 22 respectively, but are attached at the points where these portions join the connecting portion 23. This provides a path of minimum length and hence minimum resistance through the bridge element.

Resistances between the maximum and minimum values can be obtained by attaching the leads at points between the ends of the arcuate portions 21 and 22. In all cases the distance between the tips of leads 31 and 32 is the same, and is equal to the diameter of the circle in which arcuate portions 21 and 22 lie. The leads are attached to the bridge element at diametrically opposite points on this circle.

The present invention fulfills the need for a bridge assembly in which the combined resistance of the leads and the bridge element can be set at precisely one ohm, and in which the effective resistance of the bridge element can be increased or decreased in order to compensate for leads of different resistances without changing the distance between the lead tips. The resistance of a lead wire will depend on its length as well as its diameter and the resistivity of the wire metal. Since any one of these three can be varied, it is evident that the resistance of the leads will not always be precisely the same. By appropriate positioning of the bridge element, so that it is attached to the leads in either of the positions shown in FIGS. 4 or 5, in any intermediate position, a bridge assembly having an exact predetermined resistance, and in particular a resistance of precisely one ohm, can be obtained.

What is claimed is:

1. A generally S-shaped bridge element for an electro-explosive device having a pair of spaced lead wires, said bridge element comprising a first arcuate portion, a second arcuate portion spaced therefrom, and a connecting portion extending from one of said arcuate portions to the other arcuate portion, said first and second arcuate portions being arcs of the same circle, said arcuate portions and said connecting portion being resistor portions, said arcuate portions being of essentially uniform width and essentially uniform resistance per unit length, said bridge element being adapted to be attached to one of said leads at a point along said first arcuate portion and to the other of said leads at a point along said second arcuate portion, the length of electric current flow path through said bridge element and the effective resistance of said bridge element being determined in accordance with the points of attachment of said bridge element to said leads.

2. A bridge element according to claim 1 in which said connecting portion is also of essentially uniform width and essentially uniform resistance per unit length.

3. A bridge element according to claim 1 in which said connecting portion comprises a linear portion extending along a diameter of a circle and said arcuate portions are diametrically opposite arcs extending along the circumference of said circle.

4. A bridge element according to claim 1 in which said arcuate portions and said connecting portion form a smooth continuous curved structure of essentially uniform width and essentially uniform resistance per unit length.

5. A bridge element according to claim 1 including a pair of generally fan-shaped end portions extending from the ends of said arcuate portions.

6. A bridge element according to claim 1 in which said bridge element is of foil thickness.

7. In an electro-explosive device having a plug assembly comprising a pair of lead wires, an insulator plug maintaining said lead wires in spaced relationship, and a bridge element connected to said lead wires, the improvement wherein said bridge element has the structure defined in claim 1.

* * * * *

UNITED STATES PATENT AND TRADEMARK OFFICE

CERTIFICATE OF CORRECTION

PATENT NO. : 3,974,424

DATED : Aug. 10, 1976

INVENTOR(S) : John Thomas Michael Lee

It is certified that error appears in the above-identified patent and that said Letters Patent are hereby corrected as shown below:

Column 2, line 7, "and 0.001 respectively" should read -- and 0.001 inch respectively --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*